US008485946B2

(12) United States Patent
Ross et al.

(10) Patent No.: US 8,485,946 B2
(45) Date of Patent: Jul. 16, 2013

(54) TURN WEIGHT PLATE

(75) Inventors: Adam L. Ross, West Chester, OH (US); Benjamin P. Boyer, Washington Court House, OH (US)

(73) Assignee: Exemplar Design, LLC, Mason, OH (US)

( * ) Notice: Subject to any disclaimer, the term of this patent is extended or adjusted under 35 U.S.C. 154(b) by 161 days.

(21) Appl. No.: 12/967,749

(22) Filed: Dec. 14, 2010

(65) Prior Publication Data

US 2011/0319233 A1 Dec. 29, 2011
US 2012/0129661 A2 May 24, 2012

Related U.S. Application Data

(60) Provisional application No. 61/286,034, filed on Dec. 14, 2009.

(51) Int. Cl.
*A63B 21/06* (2006.01)

(52) U.S. Cl.
USPC ..... 482/93; 482/92; 482/94

(58) Field of Classification Search
USPC ..... 482/93, 98, 106, 107, 108, 109, 148, 482/908; D21/680, 681, 694
See application file for complete search history.

(56) References Cited

U.S. PATENT DOCUMENTS 1,672,944 A * 6/1928 Jowett ..... 482/108
3,825,253 A * 7/1974 Speyer ..... 482/106
3,913,908 A * 10/1975 Speyer ..... 482/106
4,076,236 A * 2/1978 Ionel ..... 482/108
4,566,690 A * 1/1986 Schook ..... 482/108
4,880,229 A 11/1989 Broussard
4,948,123 A 8/1990 Schook
5,221,244 A * 6/1993 Doss ..... 482/106
5,607,379 A 3/1997 Scott
5,735,777 A 4/1998 Benoit et al.
5,853,355 A 12/1998 Standish
D431,059 S 9/2000 Webber et al.
6,461,282 B1 10/2002 Fenelon
6,679,816 B1 1/2004 Krull
6,736,765 B2 5/2004 Wallace et al.
6,855,097 B2 2/2005 Krull
6,872,173 B2 3/2005 Krull
7,001,310 B1 2/2006 Brice
7,077,791 B2 7/2006 Krull
D528,611 S 9/2006 Flick et al.
7,121,988 B2 10/2006 Walkerdine
7,153,243 B1 12/2006 Krull
7,172,536 B2 2/2007 Liu (Continued)

FOREIGN PATENT DOCUMENTS

EP 1 447 115 A1 8/2004
WO WO 2005/046811 A1 5/2005
WO WO 2006/065954 A2 6/2006
WO WO 2008/013617 A2 1/2008

*Primary Examiner* — Glenn Richman
(74) *Attorney, Agent, or Firm* — Baker & Hostetler LLP

(57) ABSTRACT

Devices, apparatuses, systems and/or methods related to weight plates. Specifically, the disclosed devices, apparatuses, systems and/or methods relate to nested weight plates including a first weight plate increment and a second weight plate increment configured to receive the first weight plate increment. The nested weight plates may include a turning mechanism including a turning circle and/or a screw. The screw may be received by the first weight plate increment such that rotation of the turning circle engages and/or disengages the second weight plate increment. In this manner, a user may select to total weight desired.

11 Claims, 18 Drawing Sheets

U.S. PATENT DOCUMENTS

| | | | | |
|---|---|---|---|---|
| 7,198,591 | B2 | 4/2007 | Lien | |
| 7,207,929 | B2 * | 4/2007 | Hamilton | 482/106 |
| 7,223,214 | B2 | 5/2007 | Chen | |
| 7,261,678 | B2 | 8/2007 | Crawford et al. | |
| 7,377,885 | B2 * | 5/2008 | Doudiet | 482/107 |
| 2002/0002106 | A1 | 1/2002 | Krull | |
| 2003/0148862 | A1 * | 8/2003 | Chen et al. | 482/108 |
| 2004/0072662 | A1 * | 4/2004 | Landfair | 482/106 |
| 2004/0077466 | A1 | 4/2004 | Wallace et al. | |
| 2004/0220025 | A1 | 11/2004 | Krull | |
| 2005/0096195 | A1 | 5/2005 | Morrissette | |
| 2007/0135271 | A1 | 6/2007 | Lien et al. | |
| 2007/0155593 | A1 * | 7/2007 | Lien | 482/93 |
| 2008/0146420 | A1 | 6/2008 | Chen | |
| 2008/0188362 | A1 | 8/2008 | Chen | |

* cited by examiner

TURN WEIGHT PLATE

CROSS-REFERENCE TO RELATED APPLICATIONS

This application claims the benefit of U.S. Provisional Patent Application Ser. No. 61/286,034, entitled "TURN WEIGHT PLATE," filed on Dec. 14, 2009, the disclosure of which is incorporated herein by reference.

BACKGROUND

The present disclosure contemplates that weight training has been in existence for thousands of years. Uses of weight lifting may relate to health issues, sports performance, rehabilitation, and leisure activity. The advancement of health brings the development of weight lifting techniques. A better athlete may be created partially through improved weight resistance techniques. Weights may be used to help rehabilitate injuries. Further, weight lifting has grown and developed simply through leisure and professional weight lifters.

Current weight plates in the weight room are all of similar design, existing in weight plate increments of forty-five, thirty-five, twenty-five, ten, five, and two and a half pounds. These designs typically need a large area for storage, have high costs, and are inconvenient to use.

Therefore, it is desired that weight plates reduce the storage space requirements and be more convenient to use.

SUMMARY OF THE DISCLOSURE

This disclosure is drawn to devices, apparatuses, systems and/or methods related to weight plates. Specifically, the disclosed devices, apparatuses, systems and/or methods relate to nested weight plates in which the total weight of the weight plate may be selected using a locking mechanism.

BRIEF DESCRIPTION OF THE DRAWINGS

The foregoing and other features of the present disclosure will become more fully apparent from the following description and appended claims, taken in conjunction with the accompanying drawings. Understanding that these drawings depict only several embodiments in accordance with the disclosure and are, therefore, not to be considered limiting of its scope, the disclosure will be described with additional specificity and detail through use of the accompanying drawings.

In the drawings.

DETAILED DESCRIPTION

Figure 1:
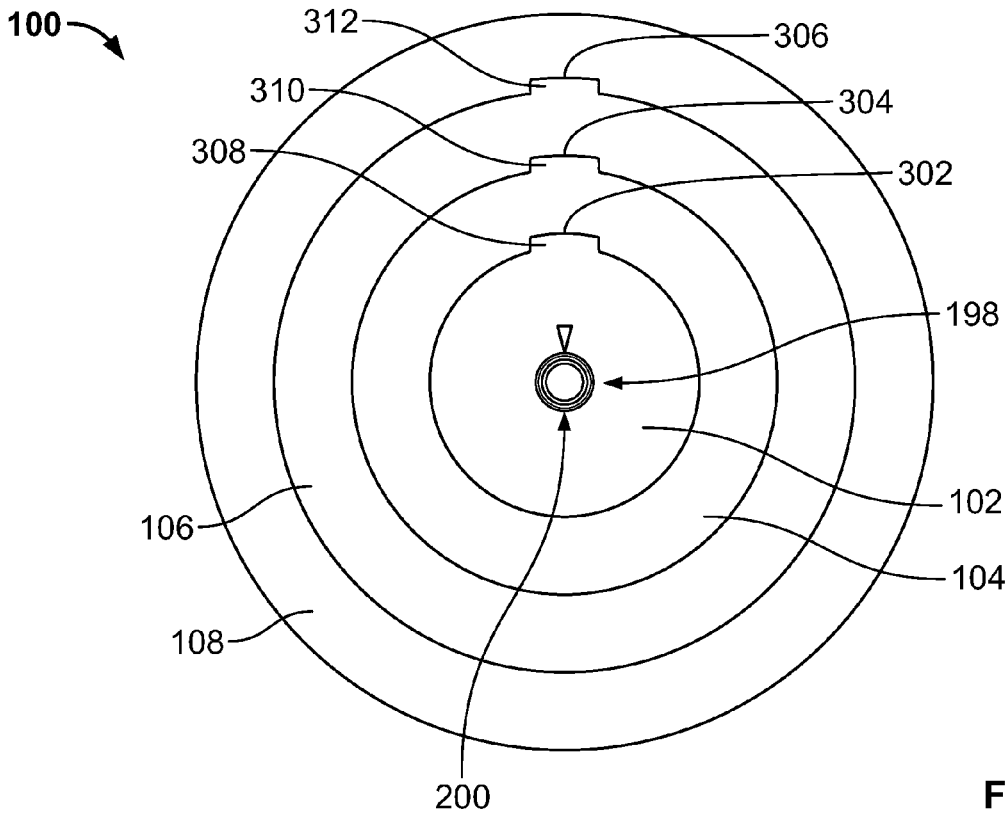
FIG. 1 is a diagram depicting an example embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, may be arranged, substituted, combined, and designed in a wide variety of different configurations, all of which are explicitly contemplated and make part of this disclosure.

The present disclosure contemplates that there exists no weight plate design similar to the example embodiments described herein. Current plates in the weight room are of similar design, existing in weight plate increments of forty-five, thirty-five, twenty-five, ten, five, and two and a half pounds. Example embodiments may reduce space needed to store weights in a weight room. Example embodiments may replace all of the weights listed above. Example embodiments may provide a multi-purpose weight plate; uses may be in home gyms and smaller gyms, along with large commercial weight rooms and rehabilitation centers. Example embodiments may prove useful to all members of the weight-training world.

In an example embodiment, a nested weight plate is provided that includes a first weight plate increment, a second weight plate increment configured to receive the first weight plate increment, and a locking mechanism. In some embodiments, the locking mechanism may be a turning mechanism including a screw. The turning screw may be received in the first weight plate increment such that rotation of the screw in a first direction causes the screw to extend into and engage the second weight plate increment. Further, rotation of the screw in a second direction (e.g., opposite the first direction) causes the screw to retract from and disengage from the second weight plate increment. In this manner, a user may select from a first weight or a second weight. In some embodiments, the turning mechanism may also include a turning circle configured to be coupled to the screw. In some embodiments, rotation of the turning circle causes rotation of the screw.

In some embodiments, the locking mechanism may be received in the first weight plate. In some embodiments, the locking mechanism may move freely within the first weight plate. For example, a screw may be inserted through the underside (e.g., bottom) of the weight plate(s) and screwed in place, and then a cap (e.g., a turning circle) may be snapped on the topside (e.g., top) of the weight plates to lock the weight plates together.

Figure 11:
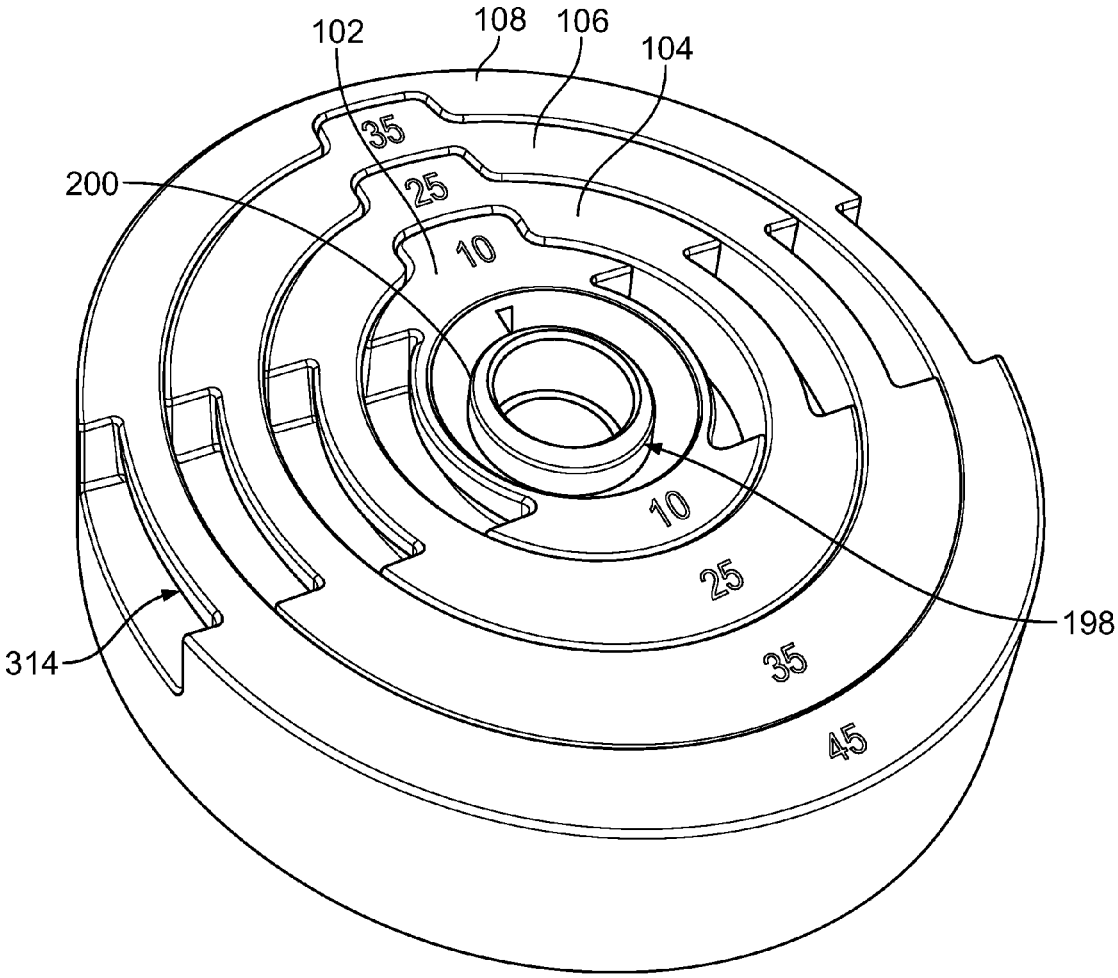
FIG. 11 is a perspective view depicting another example embodiment.

In an example with only two weight plate increments, a user may select either the weight of the first weight plate increment only, or the weight of the combination of the first weight plate increment and the second weight plate increment. For example, if a first weight plate increment weighs ten pounds and a second weight plate increment weighs twenty pounds, a user may rotate the screw to select a ten pound weight plate (i.e., the first weight plate increment) or a thirty pound weight plate (i.e., the combination of the first and second weight plate increments). While a basic example of two weight plate increments is described, it is within the scope of the present disclosure that any number (e.g., two, four, ten, one hundred) of weight plate increments may be combined in various embodiments. For example, FIG. 11 depicts an embodiment having four weight plate increments.

In some examples, a third weight plate increment may be configured to receive the second weight plate increment. In some examples, rotation of the screw in the first direction may cause the screw to extend into and engage the second weight plate increment and the third weight plate increment. Rotation of the screw in a second direction (e.g., opposite the first direction) may cause the screw to retract from and disengage from the second weight plate increment and the third weight plate increment.

Example embodiments may include a plurality of weight plates that appear to be only one weight size. With the ability to pull out lesser weights from the greater ones (or greater weights from the lesser ones), it may be possible to compact numerous weight plates into one weight plate. For example, an example greater weight plate may weigh forty-five pounds in total. Such an example weight plate may include a ten pound weight that may be pulled out of a "twenty-five pound" weight which may be pulled out of a "thirty-five pound" plate which may then be pulled out of a "forty-five pound" plate. The weights associated with each plate (e.g., "twenty-five pound") refer to the total weight of the identified plate and the plates nested therein taken together, rather than the actual weight of the individual plate. It should be understood that weight plate increments may be of any shape (e.g., round, square, oval), so long as the weight plate increments are configured to be nested with one or more other weight plate increment. In some embodiments, nested weight plates may be flush against other weight plate increments. In some embodiments, nested weight plates may not be flush against other weight plate increments.

In some example embodiments, for a lesser weight to be pulled out of a greater weight, a turning mechanism may be turned to a certain position to release that lesser weight. In some example embodiments, when the turning mechanism is turned, it screws upwards and downwards through the inside of the weight plate increments. The weight plate increments may include threading that lines up when the weight plate increments are nested in place. The turning mechanism may be captured in the smallest increment so that it is always included for any weight amount. In some example embodiments, this feature may be provided by cuts in the smallest weight plate increment and a snap on lid (e.g., turning circle) on top of the screw. In some example embodiments, the turning circle may be labeled with weight plate increment indicia so that a user knows how much weight they are using.

An example screw may include a stop before the smallest weight plate increment and/or after the largest weight plate increment so that, when the screw is completely at the top or bottom, the user knows to turn the mechanism the other way. In some examples, the turning circle may be rotatable up to 360 degrees. As the turning mechanism is turned clockwise, the screw may thread down into the greater weights. As the turning mechanism is turned counterclockwise, it may screw back out of the greater weights. When the screw is at its highest point, it may be completely within the smallest weight plate increment. See, for example, FIG. 5. When the screw is at its lowest point, it may be threaded all the way to include every weight plate increment. See, for example, FIG. 4. It is within the scope of the present disclosure that any other types of mechanism may be utilized to combine nested weight plate increments.

In some embodiments, the screw and/or turning circle do not have to lock into place when engaging the next weight plate increment. In such examples, one or more decal on the weight plate increments may identify where to stop turning for the next weight plate increment.

The inside of the screw may be smooth and may correspond to the dimensions of a weight lifting bar so that it can be mounted and/or dismounted from the weight lifting bar.

In some examples, the first stop may correspond to the screw engaging only a first weight plate increment. In some examples, the second stop may correspond to with the screw engaging at least a first weight plate increment and a second weight plate increment.

It should be understood that the locking mechanism described herein is not limited to a turning mechanism. Embodiments including a turning mechanism having a turning circle and screw are described herein for brevity and are not meant to be limiting. Any locking mechanism configured to lock weight plates together may be utilized in some embodiments. For example, in some embodiments, a spring-loaded locking mechanism (in one or more weight plate increment) may be utilized in place of or in addition to a turning mechanism. It should also be understood that the locking mechanism described herein is not limited to the center of the weight plates. The locking mechanism may be located at any location on the weight plates.

Some examples may include one or more handles in and/or on one or more weight plate increments. For example, FIG. 11 depicts two handles on each of four weight plate increments. Some examples may have no handles, while some examples may have handles on all weight plate increments. Some examples may have handles on some weight plate increments, while other weight plate increment have none.

Some example embodiments may include tab(s) and/or cut(s) in individual weight plate increments to aid proper alignment when a weight plate increment is loaded among the other weight plate increments in the plate. In some examples, a first weight plate increment may include one or more tab configured to align the first weight plate increment with a second weight plate increment. The second weight plate increment may include one or more corresponding cut configured to receive the one or more tab. When the tabs are aligned with the cuts, rotational movement of the first weight plate increment relative to the second weight plate increment may be reduced. Such tabs and cuts may also secure the weight plate increment in the appropriate spot and provide a location for the turning mechanism. Since the weight plate increments may be designed to be placed in the correct position, the threads may always line up appropriately. Tab(s) and/or cut(s) may be of any shape, so long as they are capable of aiding proper alignment.

Example materials of the weight plates may include metal, rubber, and/or plastic. Two example plates of different size and weights may meet the needs of most weight lifters. An example heavier weight may weigh about forty-five pounds in total and/or may include weight plate increments of about ten, twenty-five, thirty-five, and forty-five pounds, for example. An example lighter weight may include increments of about two and a half, five, seven and a half, and ten pounds and/or may weigh a total of about ten pounds. It is within the scope of the present disclosure that any sizes, denominations and/or weights of weight plate increments may be combined in various embodiments.

Some example embodiments may include racking system so that the weights may be easily stored and/or so that the increments may be easily and safely placed back into one another. Through a simple cantilever frame, which may include an angled support system, the weights may be simply placed and taken out of their appropriate place with ease.

In some example embodiments, a method of using a nested weight plate having a plurality of nested weight plate increments and a turning mechanism including a turning circle and a screw, is provided. An example embodiment may include inserting the screw into at least one of the plurality of nested weight plate increments, coupling the turning circle to the screw, turning the turning circle to a position associated with a desired weight, and removing a first weight plate increment of the plurality of weight plate increments from a nested second weight plate increment of the plurality of weight plate increments. In some examples, turning the turning circle may include rotating a screw extending at least partially through the first weight plate increment and the second weight plate increment. In some examples, turning the turning circle may include aligning the turning circle with an indicia corresponding to the desired weight.

In some examples, the method may further include mounting the first weight plate increment on a weight bar. In some examples, mounting the first weight plate increment on the weight bar may include extending the weight bar at least partially through the turning circle and the screw.

Turning now to the FIGS., FIG. 1 illustrates an example turn weight plate 100 including weight plate increments 102, 104, 106, 108. Some example weight plates may include a turning mechanism 198 including a turning circle 200, cuts 302, 304, 306, and corresponding tabs 308, 310, 312. The cuts 302, 304, 306 and/or tabs 308, 310, 312 may ensure that the weight plate increments are put back into the correct place and/or orientation so that the threads may line up appropriately.

Figure 2:
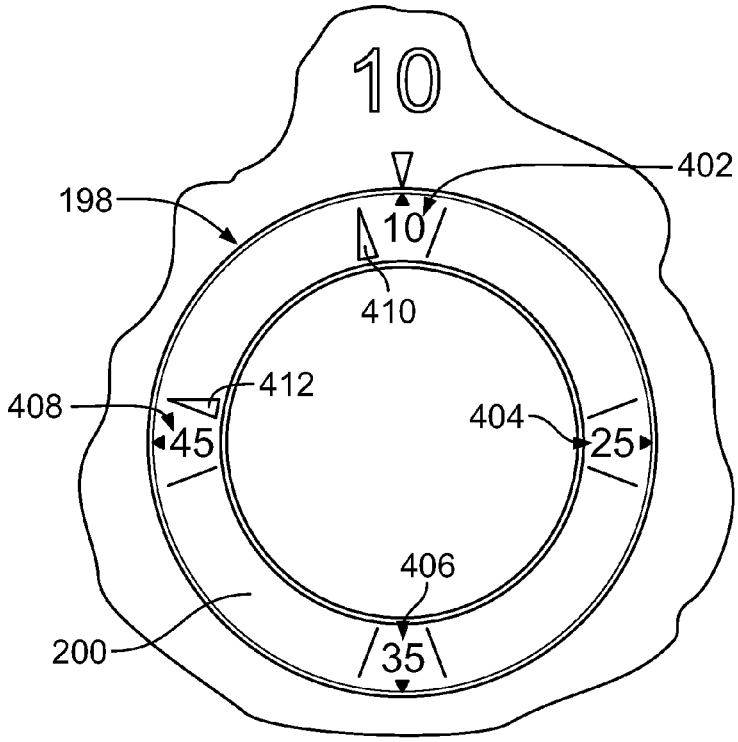
FIG. 2 is a diagram depicting another example embodiment.

FIG. 2 illustrates a close-up view of an example turning mechanism 200 in a ten pound weight plate increment 102. Note the indications 402, 404, 406, 408 of how the weight plate increments are to be chosen and how there are stops 410, 412 before and after the appropriate weights. These stop may indicate to the user that the turning circle 198 must be turned the other way for use.

Figure 3:
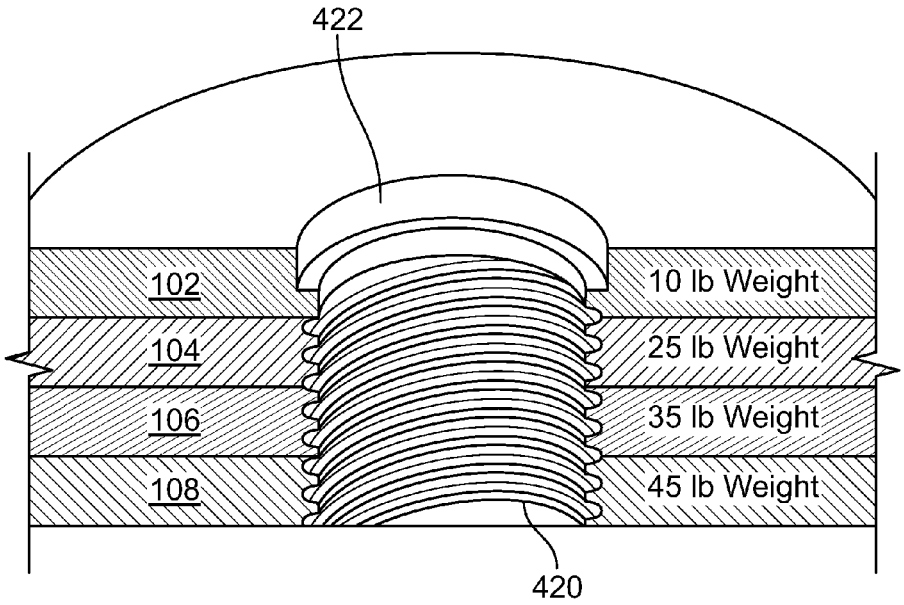
FIG. 3 is a diagram depicting another example embodiment.

FIG. 3 illustrates threads 420 inside example weight plate increments 102, 104, 106, 108 without the turning mechanism inserted. Note that the threads 420 may not cover the entire length of the inside of the weight plate increments. For example, a recessed section 422 may be provided in the ten pound weight plate 100 for receiving the turning circle 198.

Figure 4:
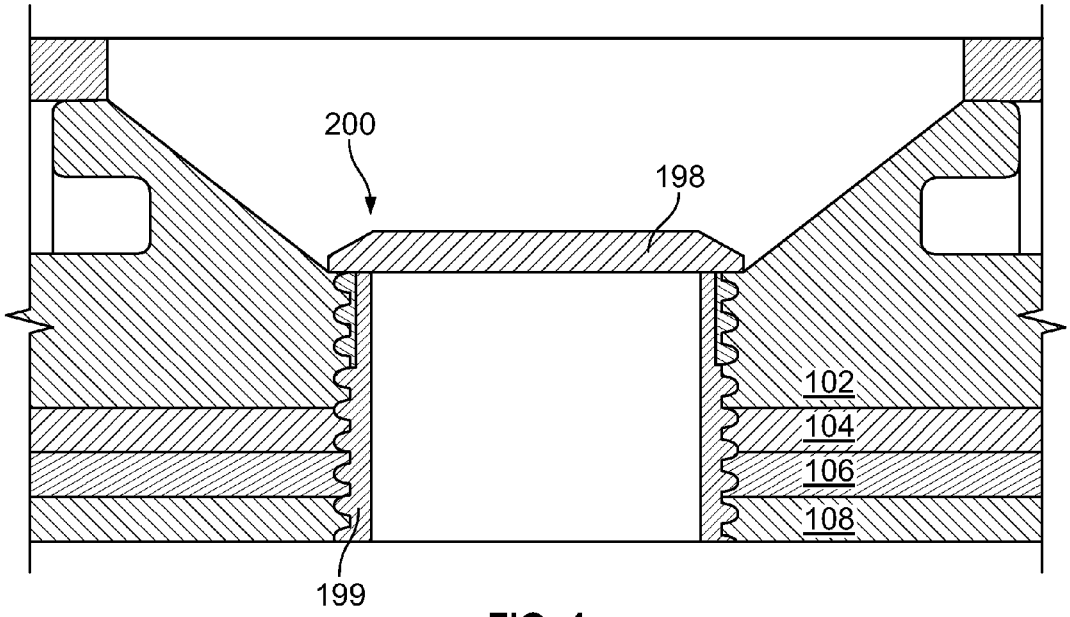
FIGS. 4-5 are cross-section diagrams depicting some example embodiments.
Figure 5:
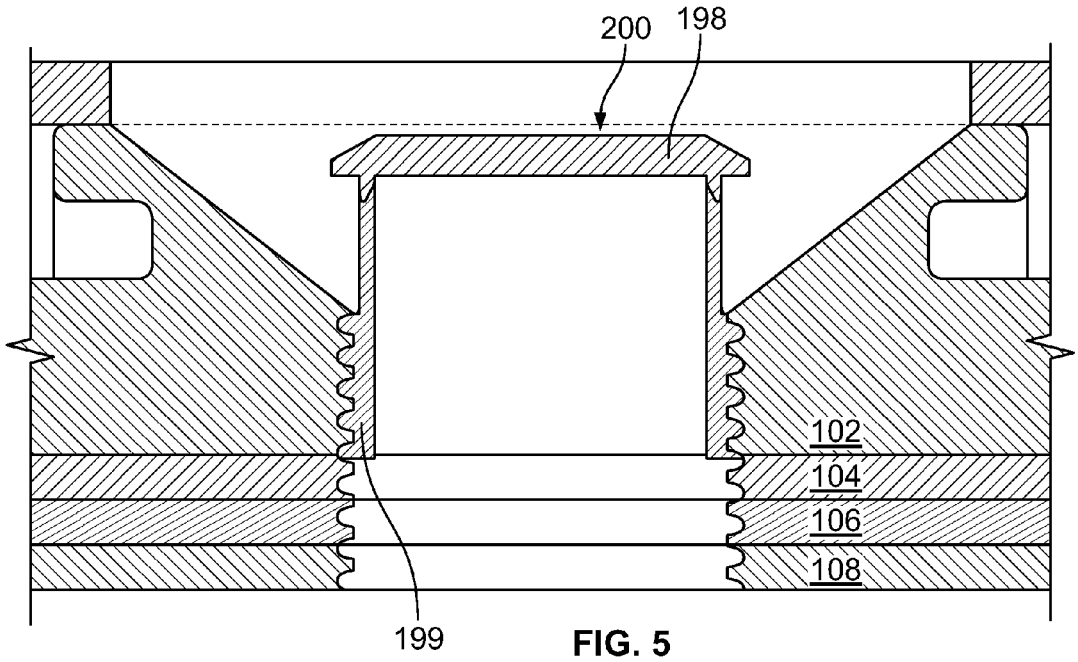
Figure 6:
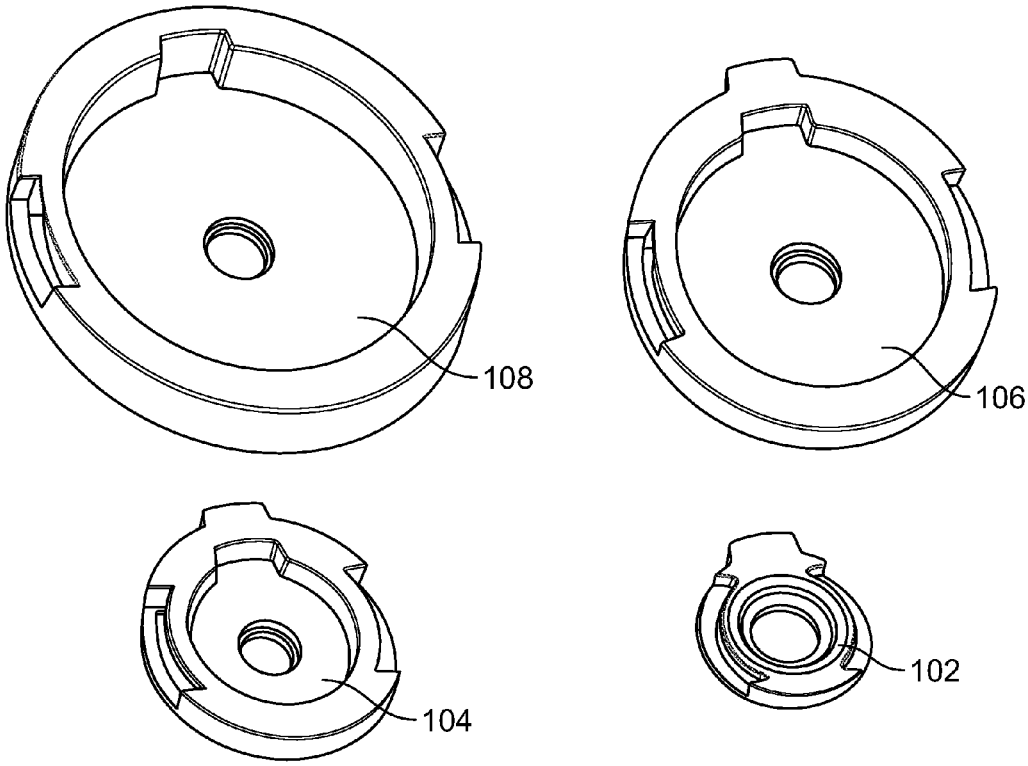
FIGS. 6-9 are perspective views depicting some example embodiments.

FIG. 4 illustrates a cross-section view of turning mechanism 200 including turning circle 198 and screw 199. In this position, screw 199 engages weight plate increments 102, 104, 106, 108. FIG. 5 illustrates screw 199 engaging only weight plate increment 102. With screw 199 in this position, weight plate increment 102 may be lifted out of and away from the other weight plate increments 104, 106, 108. In some example embodiments, turning circle 198 may remain at least partially recessed within weight plate increment 102 when screw 199 engages only weight plate increment 102. FIG. 6 illustrates example weight plate increments 102, 104, 106, 108.

Figure 7:
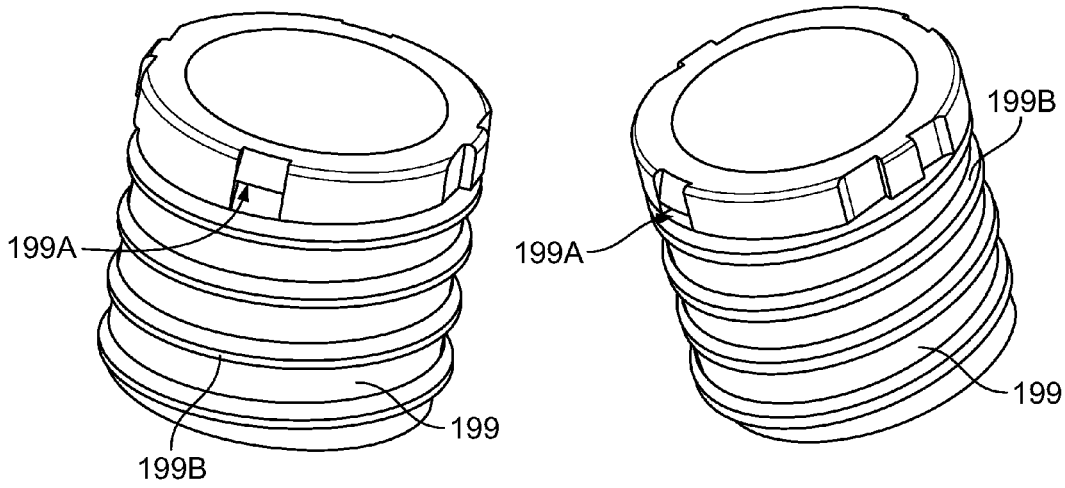
Figure 8:
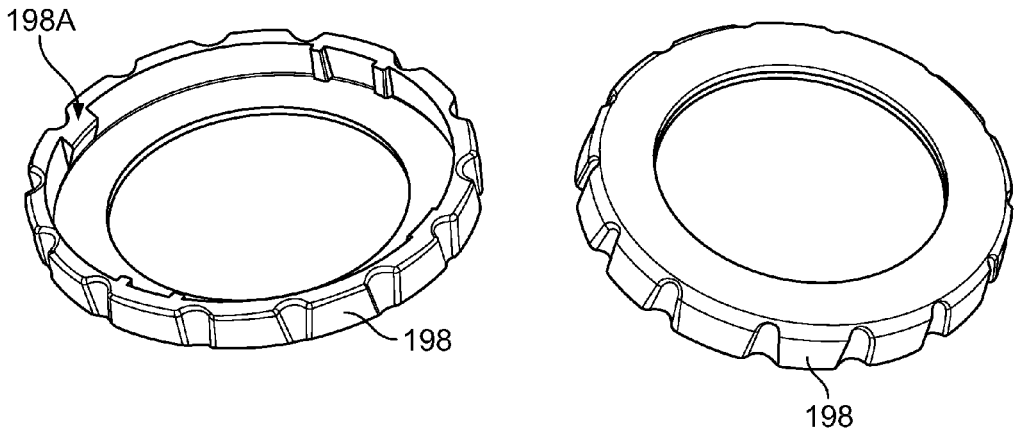
Figure 9:
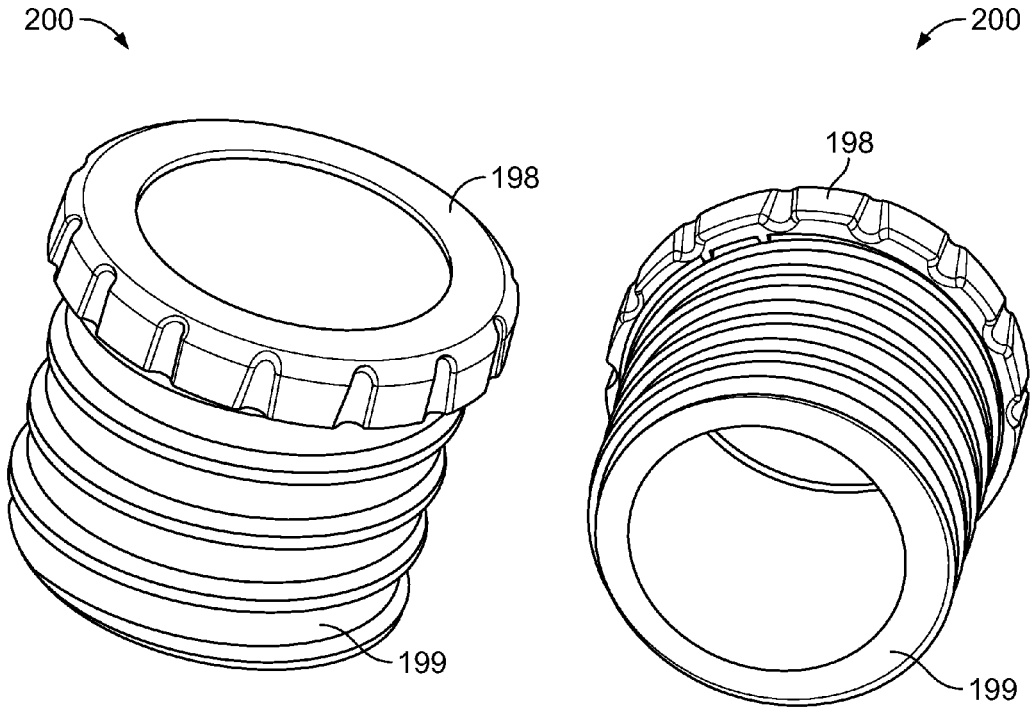

FIG. 7 illustrates an example screw 199, which may include a latch 199A for engaging turning circle 198. Screw 199 may include external threads 199B. FIG. 8 illustrates an example turning circle 198 which may engage screw 199 with a corresponding latch 198A. FIG. 9 illustrates an example turning mechanism 200, which may include turning circle 198 and/or screw 199.

Figure 10:
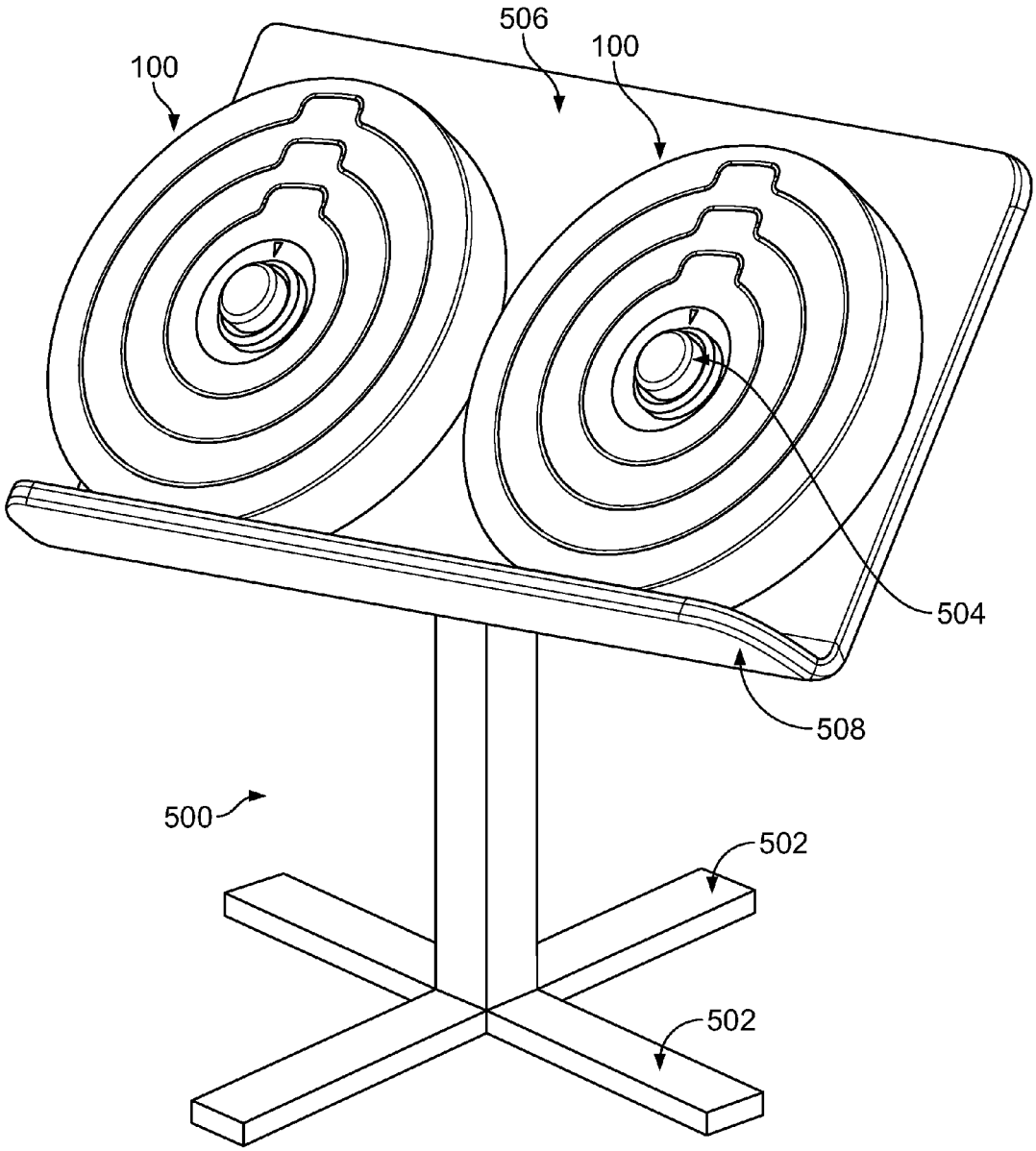
FIG. 10 is a diagram depicting another example embodiment.

FIG. 10 illustrates weight plates 100 on an example rack 500, which may include support legs 502, poles 504 for racking weights 100, a backing 506, and/or a lip 508.

FIG. 11 illustrates an example forty-five pound weight plate with example increments. Some example embodiments may include one or more handles 314, which may include cut-out portions of the weight plate increments 102, 104, 106, 108.

Figure 12:
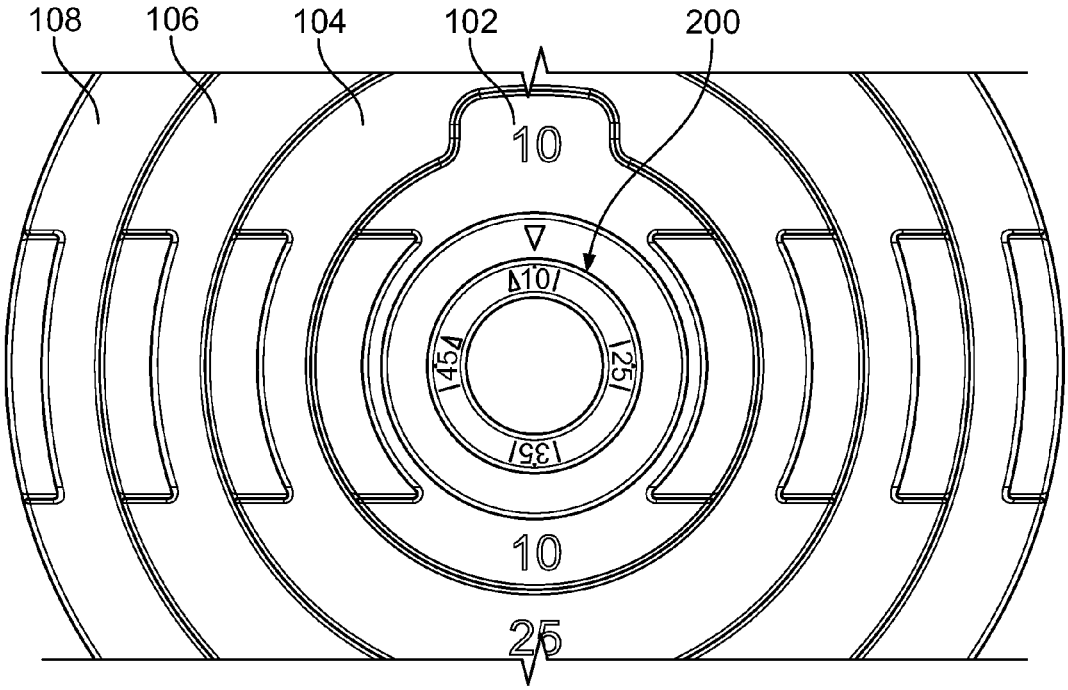
FIGS. 12-13 are diagrams depicting some example embodiments.

FIG. 12 illustrates a close-up view of an example turning circle 200 in a ten pound increment position. Note how the increments may line up with the circles and the stops may be placed before the smallest increment and after the largest increment.

Figure 13:
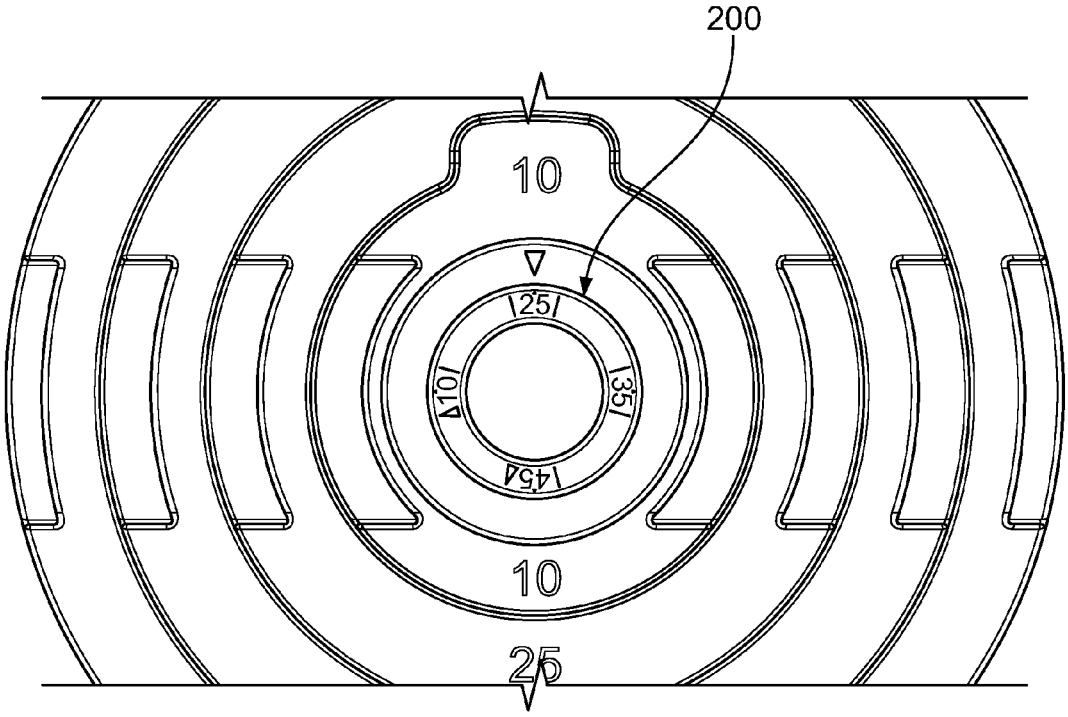

FIG. 13 illustrates a close-up view of an example turning circle 200 in a twenty-five pound increment position.

Figure 14:
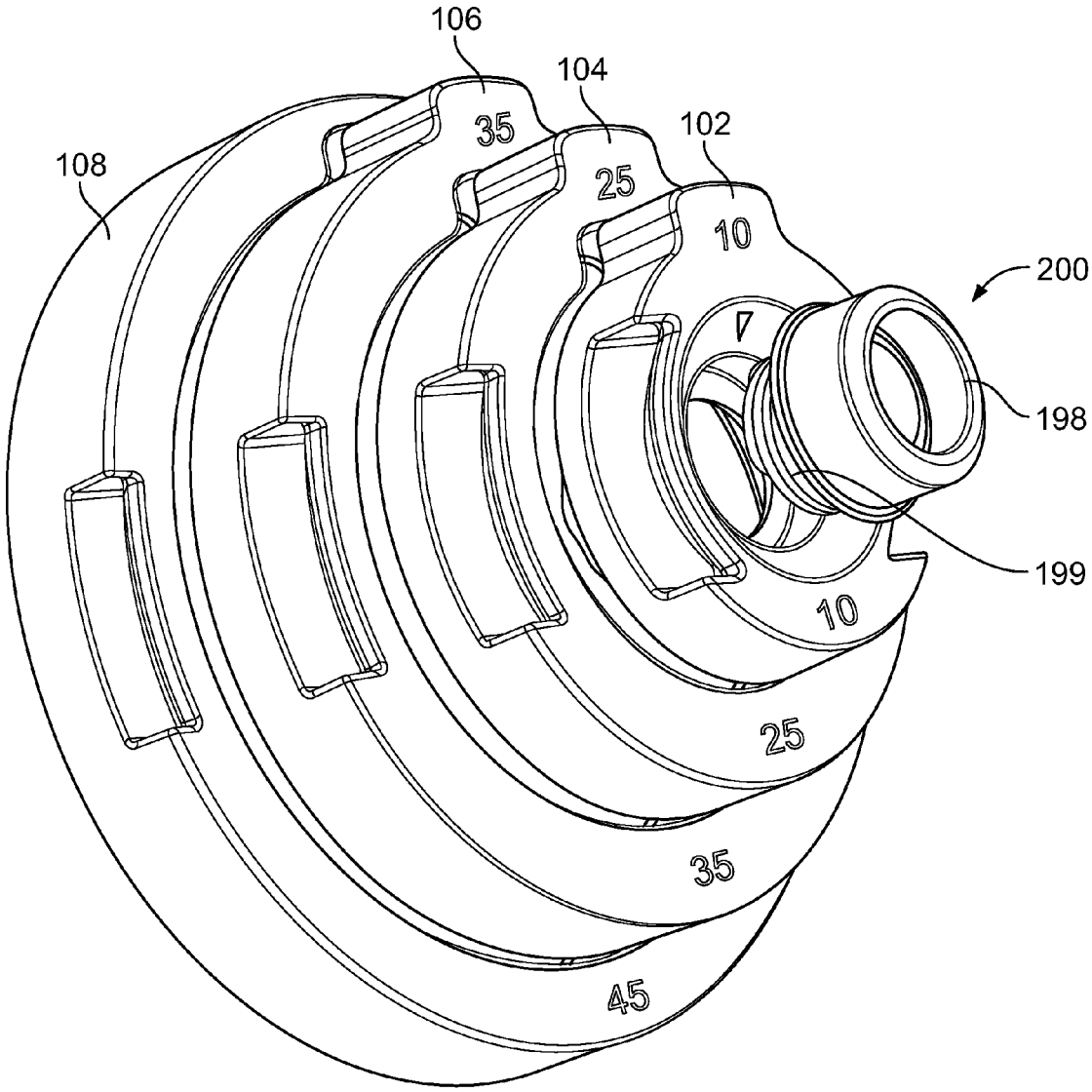
FIGS. 14-15 are perspective views depicting some example embodiments.
Figure 15:
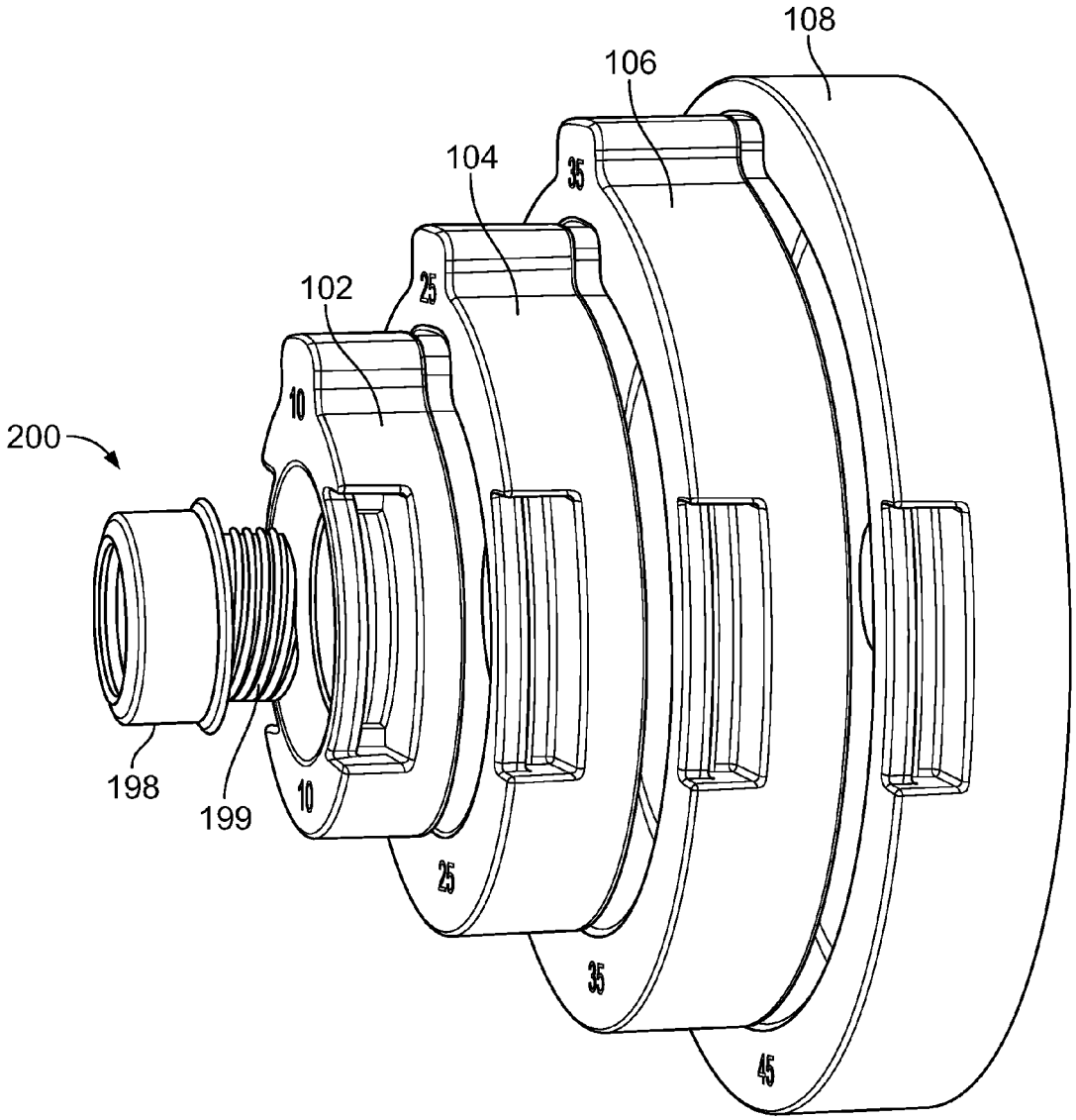
Figure 16:
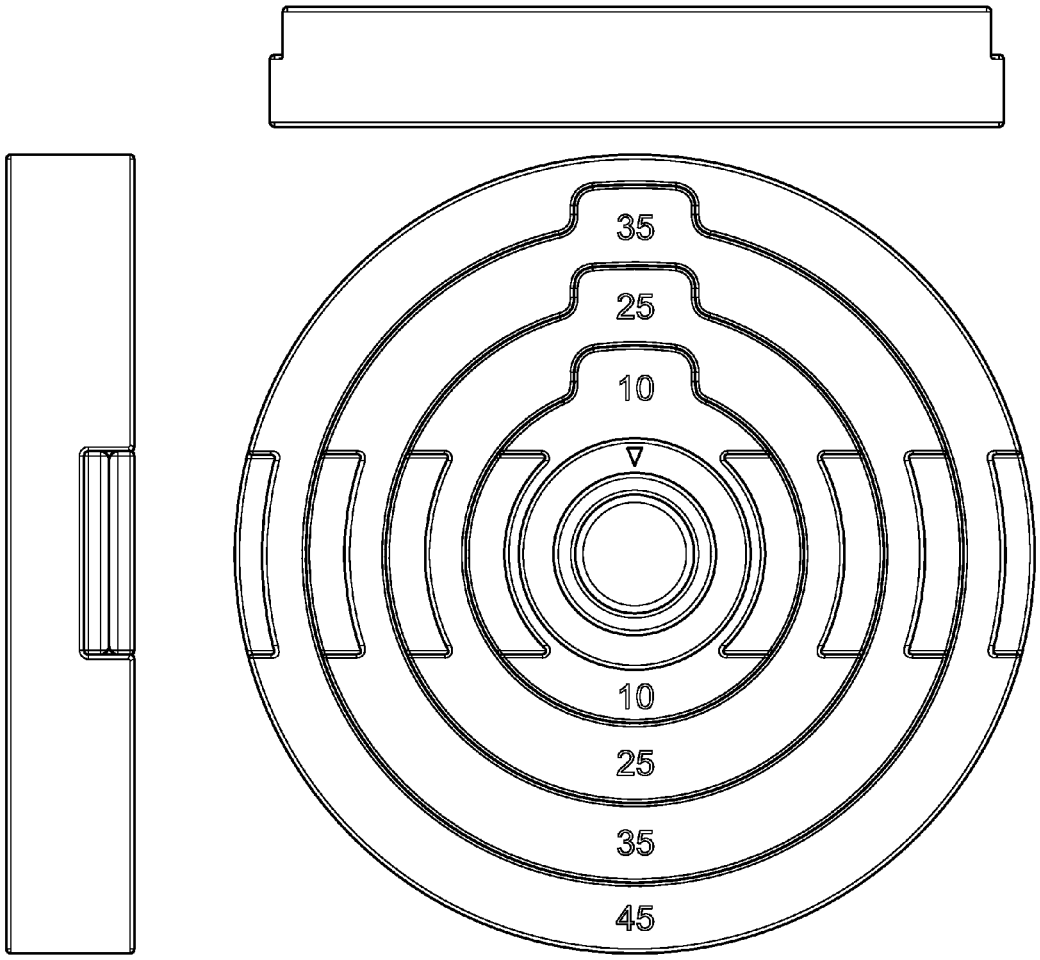
FIG. 16 is a diagram depicting a side, front, and top view of an example embodiment.
Figure 17:
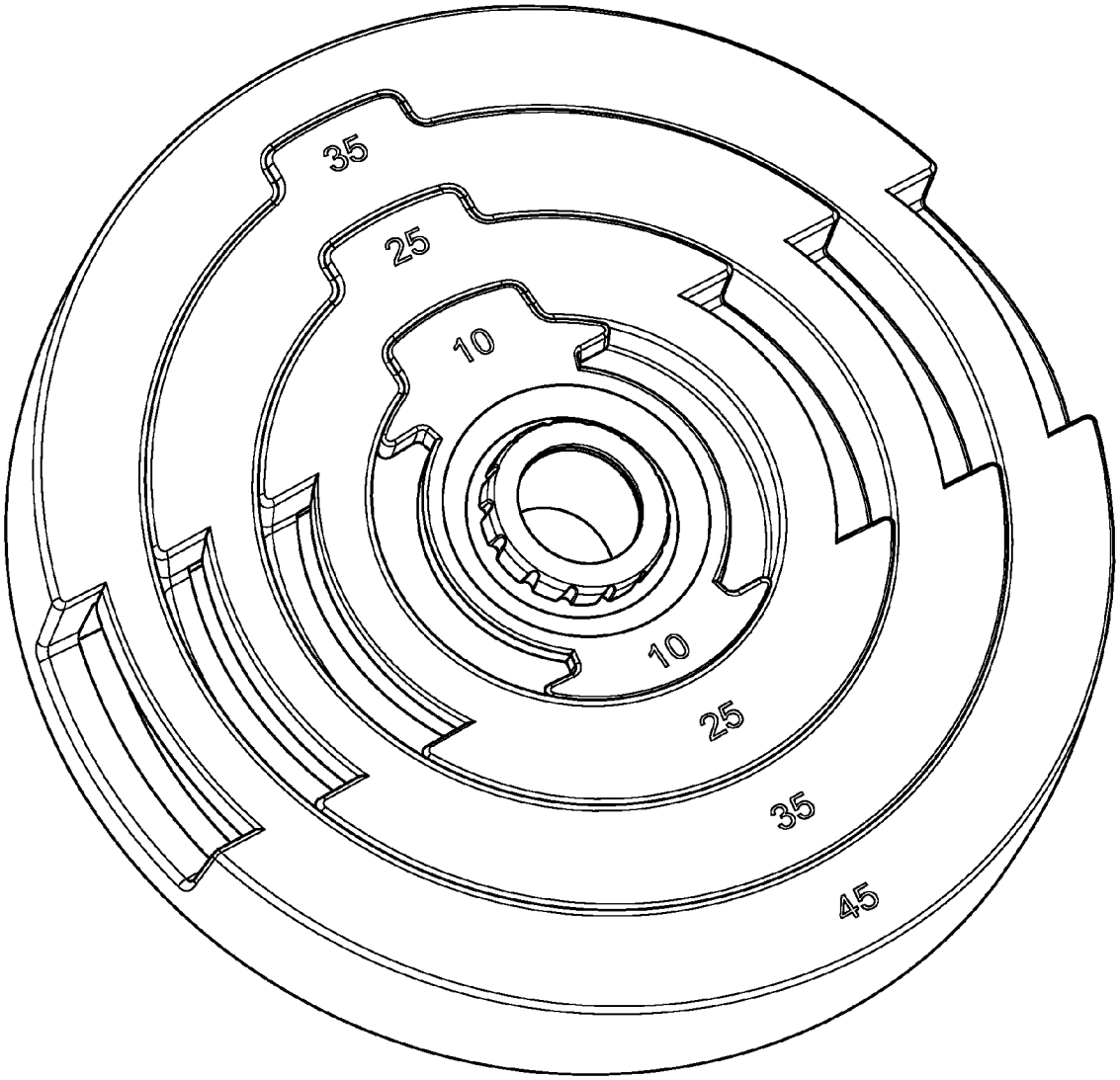
FIGS. 17-18 are perspective views depicting some example embodiments.
Figure 18:
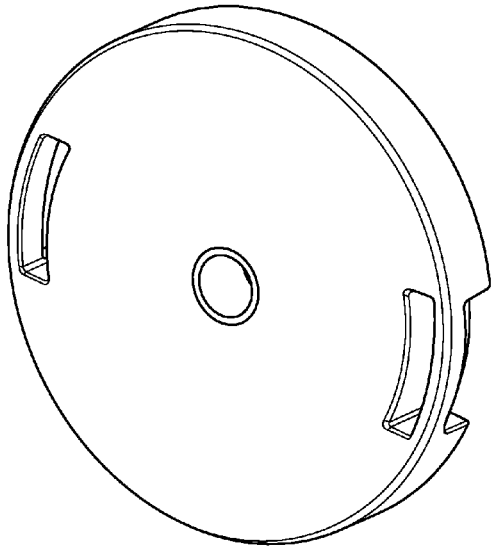

FIGS. 14 and 15 are exploded views of an example weight plate according to the present disclosure. FIG. 16 illustrates side, front, and top views of an example weight plate. FIGS. 17 and 18 are perspective views of an example weight plate.

Figure 19:
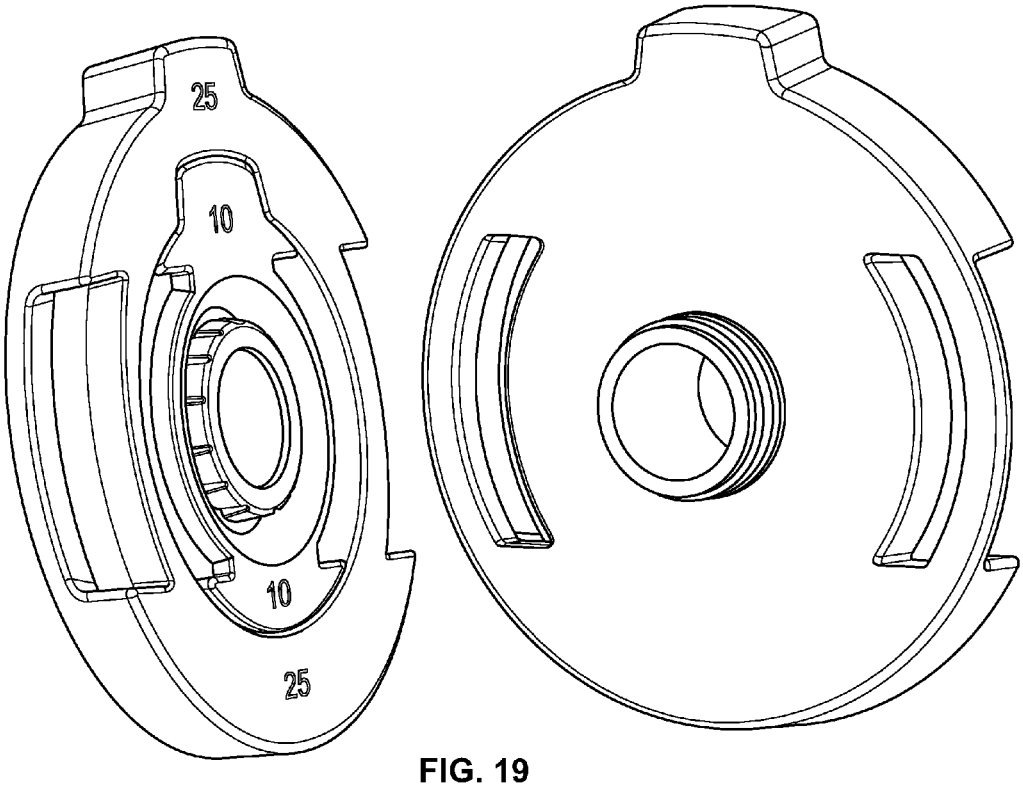
FIG. 19 is a diagram depicting another example embodiment.
Figure 20:
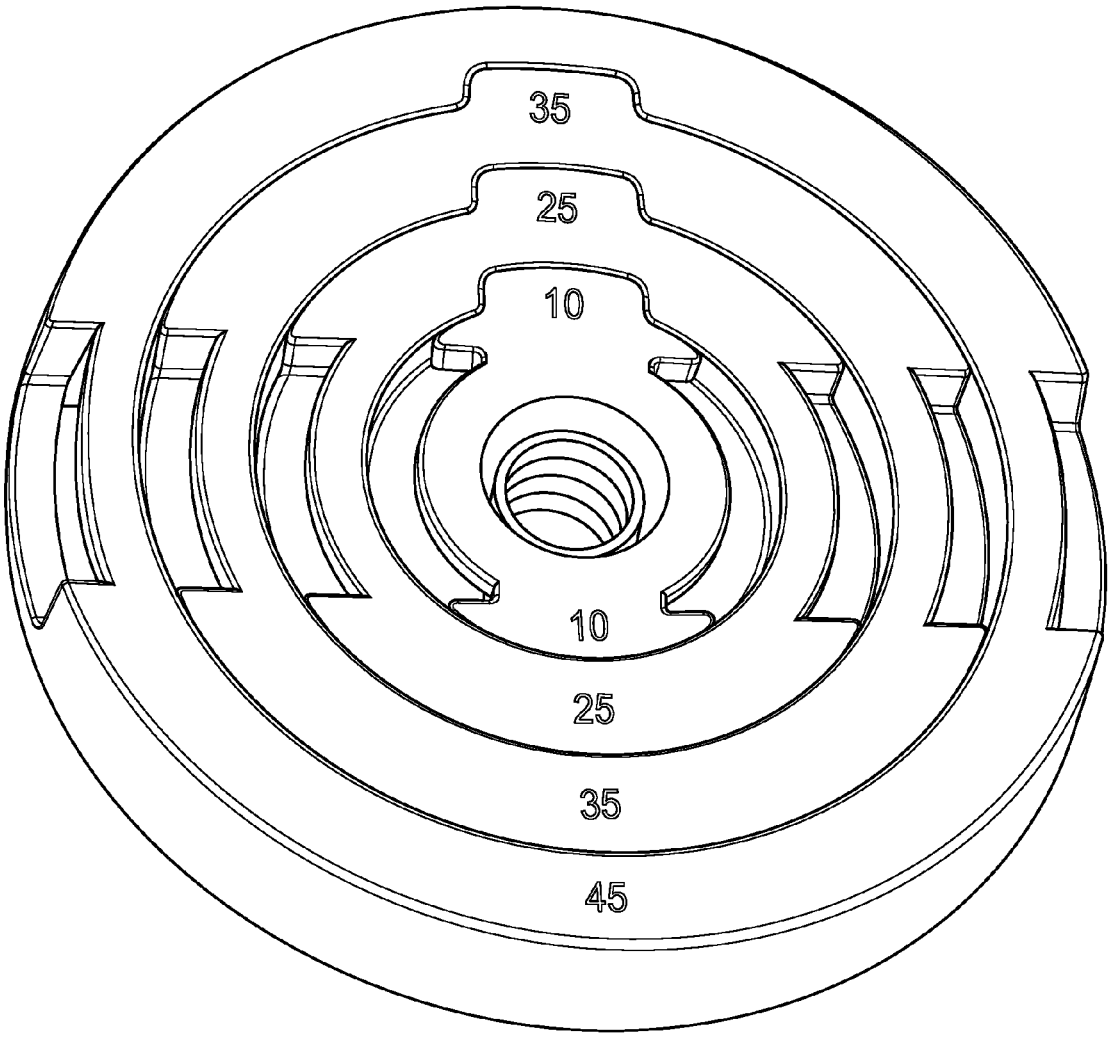
FIG. 20 is a diagram depicting a perspective view of an example embodiment.

FIG. 19 includes two perspective views of an example twenty-five pound increment and ten pound increment nested together. FIG. 19 shows the screw extending from the twenty-five pound increment to illustrate how the screw may engage larger weight plate increments; however, in normal use, the screw may not extend from the twenty-five pound increment when the twenty-five pound increment is removed from the larger increments. FIG. 20 is a perspective view of an example weight plate.

Figure 21:
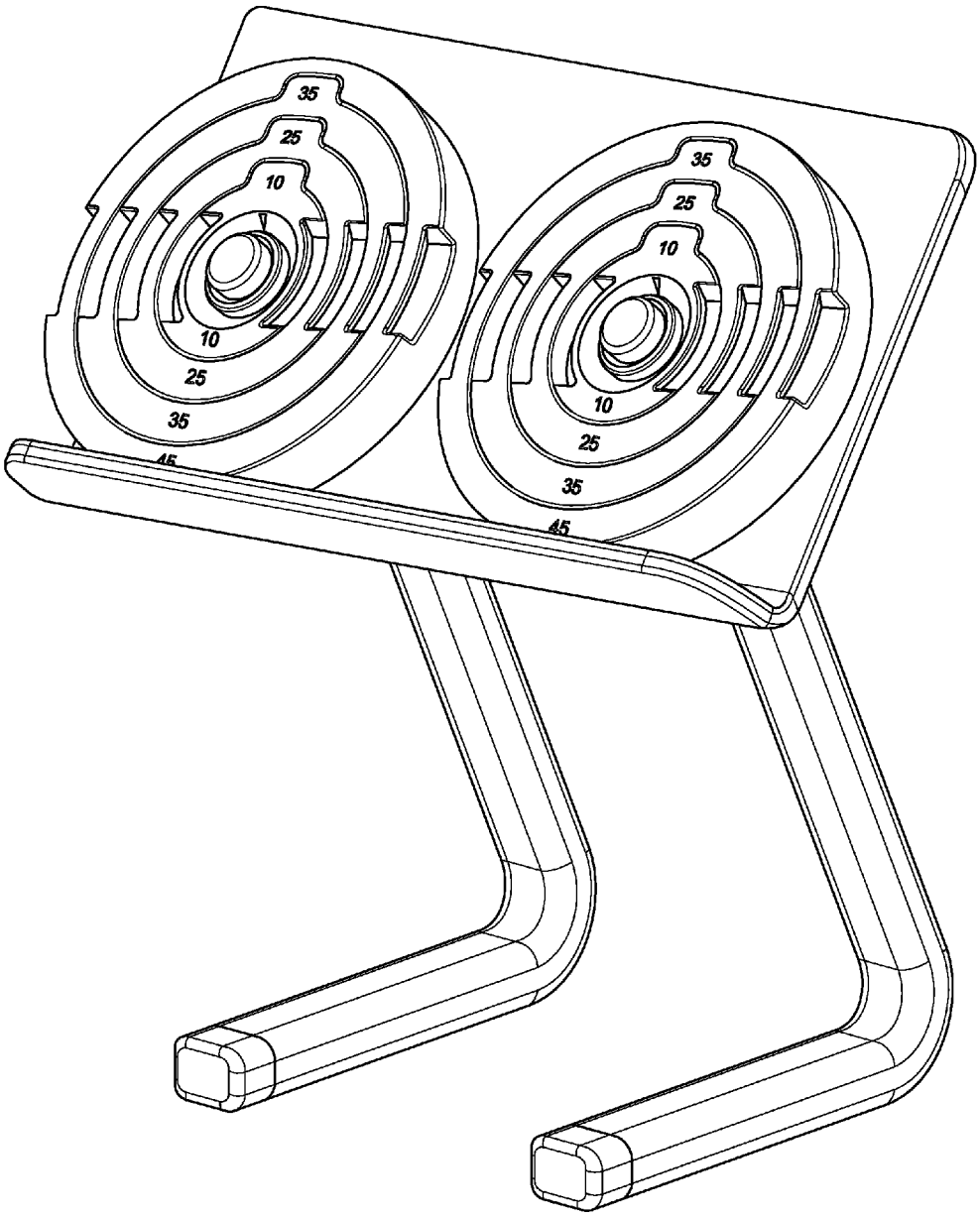
FIGS. 21-24 are diagrams depicting various views of some example embodiments.
Figure 22:
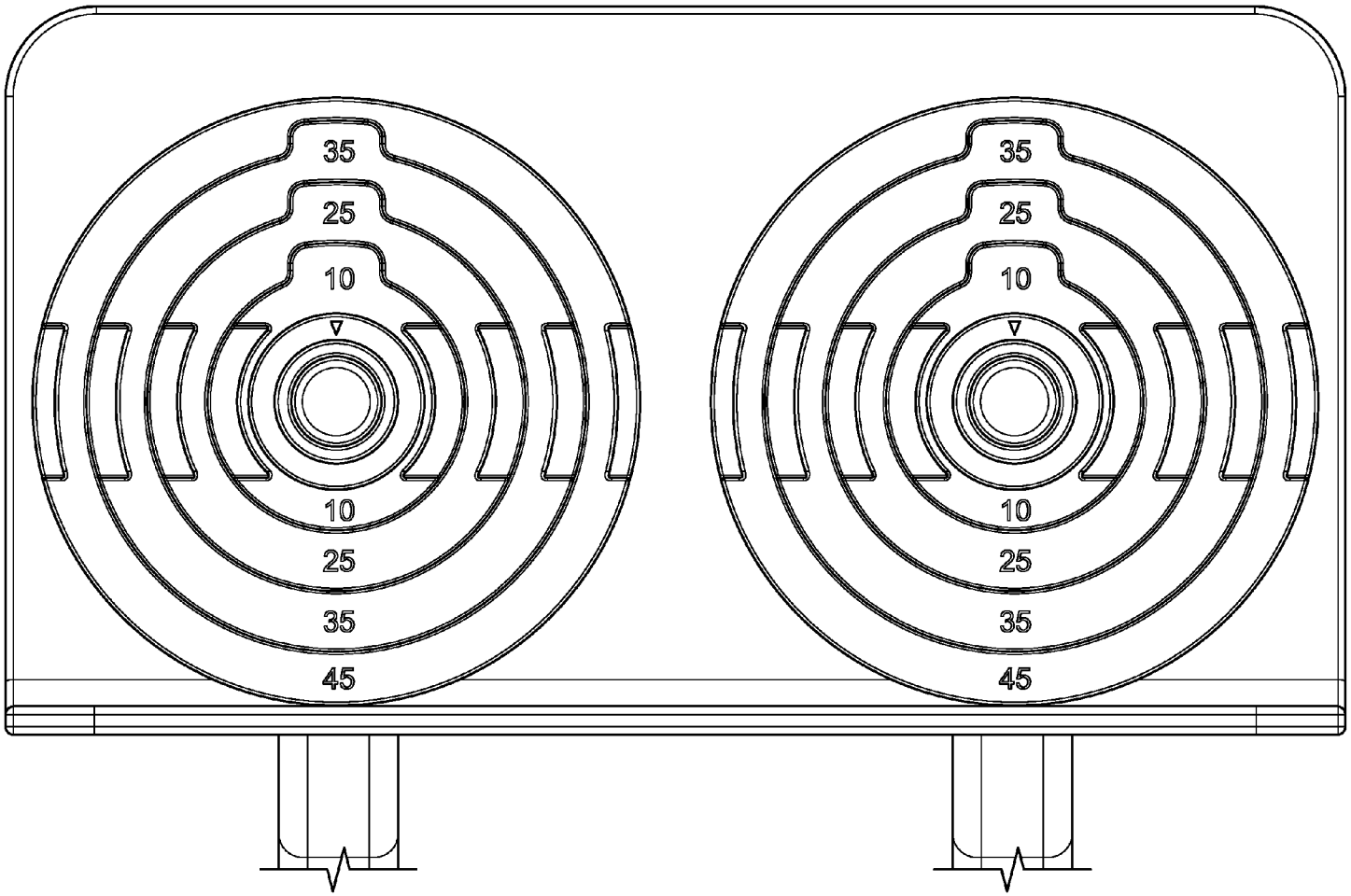
Figure 23:
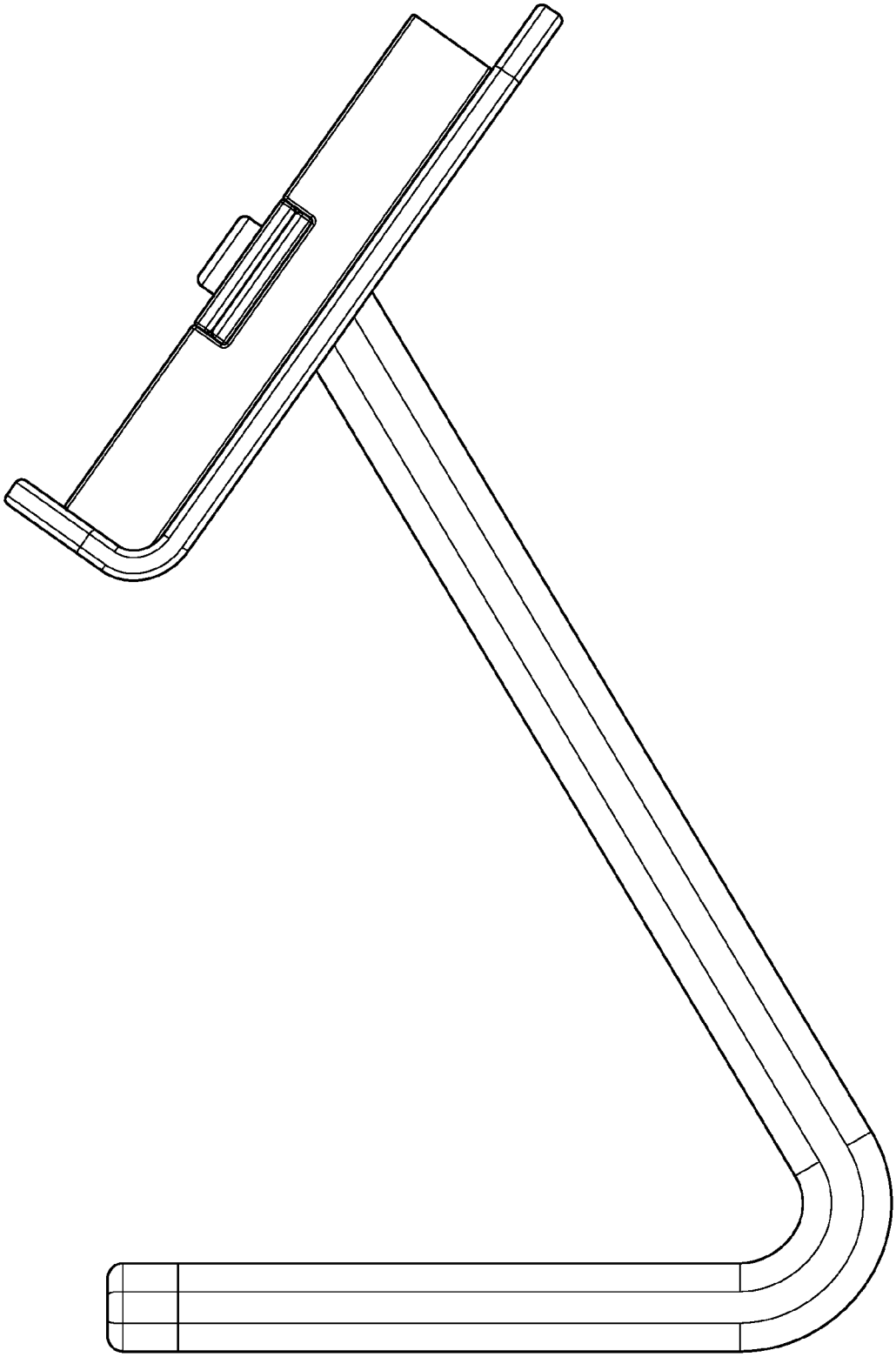
Figure 24:
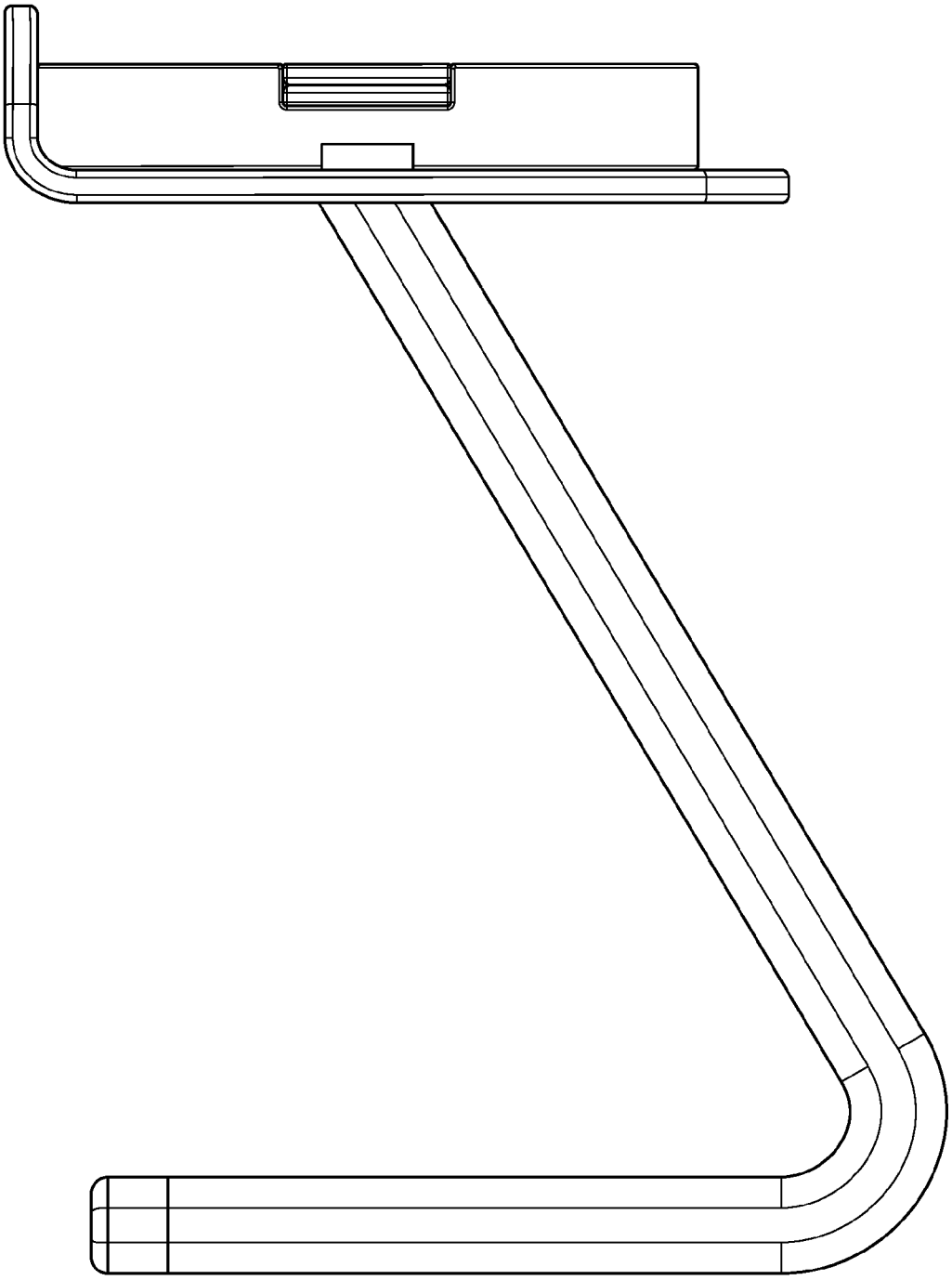

FIG. 21 illustrates weight plates on an example cantilever supported rack. FIGS. 22-24 illustrate additional views of example racks.

Following from the above description and invention summaries, it should be apparent to those of ordinary skill in the art that, while the methods and apparatuses herein described constitute example embodiments of the present invention, it is to be understood that the inventions contained herein are not limited to the above precise embodiment and that changes may be made without departing from the scope of the invention. Likewise, it is to be understood that it is not necessary to meet any or all of the identified advantages or objects of the invention disclosed herein in order to fall within the scope of the invention, since inherent and/or unforeseen advantages of the present invention may exist even though they may not have been explicitly discussed herein.

What is claimed is:

1. A nested weight plate, comprising:

a first weight plate increment;

a second weight plate increment configured to receive the first weight plate increment;

a turning mechanism including a screw, the screw being received in the first weight plate increment such that rotation of the screw in a first direction causes the screw to extend into and engage the second weight plate increment, and such that rotation of the screw in a second direction opposite the first direction causes the screw to retract from and disengage from the second weight plate increment, wherein the turning mechanism further includes a turning circle configured to be removably coupled to the screw; and wherein rotation of the turning circle causes rotation of the screw.

2. The nested weight plate of claim 1, further comprising:

a third weight plate increment configured to receive the second weight plate increment.

3. The nested weight plate of claim 2, wherein rotation of the screw in the first direction causes the screw to extend into and engage the second weight plate increment and the third weight plate increment, and such that rotation of the screw in the second direction causes the screw to retract from and disengage from the second weight plate increment and the third weight plate increment.

4. The nested weight plate of claim 1, further comprising:

a first indicia associated with a first intermediate position of the turning circle in which the screw engages only the first weight plate increment and the second weight plate increment.

5. The nested weight plate of claim 2, further comprising:

a fourth weight plate increment configured to receive the third weight plate increment; and a second indicia associated with a second intermediate position of the screw in which the screw engages only the first weight plate increment, the second weight plate increment, and the third weight plate increment.

6. The nested weight plate of claim 1, wherein at least one of the turning circle and the screw are configured to receive a weight bar therethrough.

7. The nested weight plate of claim 1, wherein at least one of the first weight plate increment and the second weight plate increment include one or more handle.

8. The nested weight plate of claim 1, wherein the first weight plate increment includes one or more tab configured to align the first weight plate increment with the second weight plate increment; and wherein the second weight plate increment includes one or more cut configured to receive the one or more tab, the one or more cut configured to align the second weight plate increment with the first weight plate increment.

9. A method of using a nested weight plate having a plurality of nested weight plate increments and a turning mechanism including a turning circle and a screw, the method comprising:

inserting the screw into at least one of the plurality of nested weight plate increments;

coupling the turning circle to the screw;

turning the turning circle to a position associated with a desired weight;

removing a first weight plate increment of the plurality of weight plate increments from a nested second weight plate increment of the plurality of weight plate increments; and mounting the first weight plate increment on a weight bar;

wherein mounting the first weight plate increment on the weight bar includes extending the weight bar at least partially through the turning circle and the screw.

10. The method of claim 9, wherein turning the turning circle includes rotating the screw extending at least partially through the first weight plate increment and the second weight plate increment.

11. The method of claim 9, wherein turning the turning circle includes aligning the turning circle with an indicia corresponding to the desired weight.

* * * * *